United States Patent · [19]

Laskaris

[11] Patent Number: 4,492,090

[45] Date of Patent: Jan. 8, 1985

[54] CRYOSTAT FOR NMR MAGNET

[75] Inventor: Evangelos T. Laskaris, Schenectady, N.Y.

[73] Assignee: General Electric Company, Schenectady, N.Y.

[21] Appl. No.: 533,336

[22] Filed: Sep. 19, 1983

[51] Int. Cl.[3] ..... F17C 7/02

[52] U.S. Cl. ..... 62/55; 138/112; 138/114; 285/47; 285/DIG. 5

[58] Field of Search ..... 62/45, 55, 514 R; 285/47, DIG. 5; 138/112, 114; 220/437, 439, 901

[56] References Cited

U.S. PATENT DOCUMENTS

| | | | |
|---|---|---|---|
| 3,110,324 | 11/1963 | DeHaan | 138/114 |
| 3,155,265 | 11/1964 | Reese | 220/437 |
| 3,326,244 | 6/1967 | Charles et al. | 138/114 |
| 3,351,224 | 11/1967 | Anderson | 138/114 |
| 3,485,272 | 12/1969 | Schmidt et al. | 138/112 |
| 3,706,208 | 12/1972 | Kadi et al. | 62/55 |
| 3,791,416 | 2/1974 | Ziemek et al. | 138/114 |
| 3,904,394 | 9/1975 | Prast et al. | 62/55 |

*Primary Examiner*—Ronald C. Capossela

*Attorney, Agent, or Firm*—Lawrence D. Cutter; James C. Davis, Jr.; Marvin Snyder

[57] ABSTRACT

A cryostat which is particularly useful for containing superconducting windings for a magnet to provide high strength magnetic fields for NMR imaging comprises a set of nested annular vessels in a suspension system which permits transport of the cryostat and magnet assembly with vacuum conditions intact. In particular, sets of transverse ties linking certain vessels to the next adjacent outer vessel are employed to prevent transverse motion of the cryostat assembly. Furthermore, during transport, a system of pins is employed to prevent axial motion, while at the same time minimizing thermal conductivity. During transport, the inner annular assemblies are locked in a fixed axial position which permits transport of the cryostat in a vertical position. A system of the present invention is therefore seen to satisfy the competing requirements for a strong internal support system for transport, but yet at the same time provides a suspension system which does not significantly impair the thermal insulation requirements of good cryostat design.

16 Claims, 13 Drawing Figures

4492090

300
301
110a 502
503
501
500
505
504
507
506
552
551
525
110
111b
121
216
215
553
215b
111
217
210b
120
504
550
100
508
200
101
116
210

CRYOSTAT FOR NMR MAGNET

BACKGROUND OF THE INVENTION

The present invention relates to cryostat construction and in particular is related to the construction of cryostats which are employable in nuclear magnetic resonance (NMR) imaging systems and/or which contain superconducting coils which are cooled by a fluid such as liquid helium.

Conventional cryostats for NMR imaging systems typically require disruption of the cryostat vacuum for the purpose of inserting temporary stiffening supports to protect the magnet and internal components during transportation. Transportation of such superconducting magnets is therefore seen to require re-establishment of internal vacuum conditions after the magnet is disassembled to remove the temporary support. This is a time consuming operation. In conventional cryostat designs, large elastomer seals are commonly employed to facilitate assembly and disassembly. Furthermore, other cryostat designs have included a nonmetallic cryostat bore tube wall to prevent eddy current field distortions when NMR gradient coils are energized. These gradient coils are typically disposed within the bore of the magnet assembly. However, both elastomer seals and nonmetallic bore tubes are permeable to gases and either design results in contamination of the internal vacuum conditions during long-term operation of the device. Therefore, costly periodic pumping of the cryostat is required. Moreover, there is a further periodic requirement for total shutdown and a warming of the superconducting windings to ambient temperature at which superconducting properties are no longer exhibited. Accordingly, it is seen that it is desirable to permanently maintain vacuum conditions within the cryostat, not only for purposes of transport but also for purposes of long-term operation.

Conventional cryostat designs also typically employ an access port for addition of coolants such as liquid helium in awkward positions on top of the cylindrical cryostat structure. Such coolant access means are conventionally disposed on the curved side surface of the cryostat and add significantly to the overall dimensions of the cryostat assembly. This is a significant disadvantage for cryostats employed to house superconducting windings which are used to produce a high intensity magnetic field for whole body NMR imaging applications. Since the bore tube of the magnet assembly must be sized to accommodate the human form with the bore tube typically being approximately one meter in diameter, the overall size of the magnet and cryostat significantly affects the cost, most notably of the magnet itself but also the cost of the room or structure in which it is housed. Accordingly, it is desired to provide a cryostat housing having horizontal access means for addition of the liquid coolant, these means being located at the end surface of the cylindrical structure.

SUMMARY OF THE INVENTION

In accordance with a preferred embodiment of the present invention, a cryostat assembly comprises: an outer evacuable vessel with an annular shape; an interior vessel also having an annular shape which is wholly contained within the outer vessel, each of these vessels being disposed so as to substantially share the same longitudinal axis. Furthermore, the cryostat of the present invention comprises a first set of at least three supporting ties disposed at one end of the cryostat and a second set of at least three supporting ties disposed at the other end of the cryostat. The supporting ties extend transversely from attachment points on the interior vessel to corresponding attachment points on the outer vessel, these attachment points being substantially uniformly disposed around the periphery of the respective vessels. The sets of supporting ties at opposite ends of the cryostat are disposed substantially in mirror image symmetry to each other with respect to a plane passing through the longitudinal axis of the cryostat. The transverse supporting ties act to maintain the outer and interior vessels in a spaced apart condition so that a vacuum may be maintained between them. Furthermore, the supporting ties comprise a material which exhibits both high tensile strength and low thermal conductivity, to minimize conductive losses between the outer and interior vessels. The placement of the supporting ties in a mirror image symmetry configuration acts to prevent a rotational motion of the interior vessel about the longitudinal axis. Nonetheless, the supporting system of the present invention does provide a certain limited degree of relative axial motion between the interior and outer vessels. This axial freedom is an important aspect of the present invention in that it allows the utilization of a structure comprising three or more pins which permit easy transportation of the cryostat, even under vacuum conditions. In particular, the structure of the cryostat of the present invention allows the interior vessel to be held against the outer vessel through this set of low thermal conductivity pins. In this way the cryostat may be transported with vacuum conditions intact, with the longitudinal cryostat axis being oriented vertically. In this transport position, the strongest forces on the cryostat structures are those which are directed transversely with respect to the longitudinal axis. However, motion in this direction is prevented by the supporting ties. The vertical forces resulting from transport of the cryostat are absorbed by the set of pins which are disposed between the outer vessel and the interior vessel and which serve to maintain them in a spaced apart relationship, while at the same time the low thermal conductivity nonetheless provides thermal isolation. While this thermal isolation is not ideal for long-term conditions because of the physical contact involved, nonetheless, when the cryostat is installed in its normal position with the longitudinal axis horizontal, the pins no longer form a physical thermal bridge between the outer and interior vessels.

Moreover, the present invention also preferably includes a horizontal coolant access port. This port not only serves as a means for the introduction of a coolant such as liquid helium, or liquid nitrogen, but also provides an access means for insertion of a positioning rod. Prior to transport of the cryostat of the present invention this rod is inserted into the horizontal access port and is of such a length and design that it pushes against the interior vessel structures so as to move them in an axial direction. In this way the interior vessel is forced into contact with the outer vessel prior to moving the cryostat into a vertical position. The positioning rod is used to cause the set of vertical support pins to abut the outer and interior vessels. The pins may, if desired, be provided with peripherally beveled edges which mate with corresponding structures in the outer and interior vessels, for purposes of alignment and further protection against transverse motion during transport.

For the purposes of providing a cryostat which is particularly useful in maintaining superconductive materials below their critical temperature in order to produce high intensity magnetic fields for NMR imaging, it is desirable to provide a somewhat more complex cryostat structure than that described so far. In particular, a cryostat for this purpose further includes a third, inner most vessel, also having an annular shape and being wholly contained within the above described interior vessel. This innemost vessel is suspended within the interior or middle vessel in the same way that the interior vessel is suspended within the outer vessel, that is, by means of a system of supporting ties configured in substantially the same manner as the supporting ties between the outer vessel and the interior vessel. In short, then, a preferred embodiment of the present invention for NMR imaging purposes includes a nested set of three annular vessels, each of which is wholly contained within the other, these vessels being: an outer, evacuable vessel; an interior vessel; and an innermost vessel. Additionally, a radiation shield may also be disposed between the innermost vessel and the interior vessel to further reduce thermal losses. The interior vessel also preferably contains a liquid coolant, such as liquid nitrogen. The innermost vessel preferably contains a lower boiling point coolant, such as liquid helium. It is within the innermost vessel that electrical windings comprising superconductive material are disposed for the purpose of establishing a high strength, uniform magnetic field having its principal component directed parallel to the longitudinal axis of the cryostat, the magnetic field being present within the bore tube formed by the annular cryostat construction.

A preferred embodiment of the present invention also includes a set of pins mounted on one end of the interior vessel so that an axial force exerted on the innermost vessel can be made to bring the pins into contact with the outer vessel and the innermost vessel. The suspension system of the present invention permits sufficient axial motion to make this possible. It is this abutting positioning of the various vessels of the present invention which facilitates the transport of the cryostat in a vertical position without the necessity of disturbing vacuum conditions within the cryostat. Furthermore, the configuration of the present invention also permits transport of a fully charged cryostat, containing both liquid nitrogen and liquid helium. In the present invention, the axial force needed to move the vessels into an abutting position is provided by means of a specially configured positioning shaft which is inserted into the liquid helium access tube extending from the exterior of the cryostat to the interior of the innermost vessel. The access structure is configured so that a specially designed shaft of proper length inserted into the access fill tube causes axial motion of the vessels to the extent permitted by the low thermal conductivity pins. The cryostat may then be moved into a position with its longitudinal axis oriented vertically for purposes of transport. However, it should be understood that transport of the cryostat of the present invention is also possible with the cryostat in a horizontal position. The transport position preference may be determined at least in part by the pin shape.

Accordingly, it is seen that one of the objects of the present invention is the construction of a cryostat including a suspension system, which is not only sturdy but which also provides a significant amount of thermal isolation between the cryostat vessels.

It is also an object of the present invention to provide a cryostat which is particularly useful in the containment of superconductive windings for the purpose of generating high strength, uniform magnetic fields for NMR imaging.

It is a further object of the present invention to provide a cryostat which is readily transportable, either in a horizontal or vertical position, with intact vacuum and liquid coolant charging conditions.

It is a still further object of the present invention to provide a cryostat in which a certain degree of axial motion is permitted between the cryostat vessels.

It is also an object of the present invention to provide a cryostat having a substantially entirely welded construction.

It is a further object of the present invention to provide a superconducting magnet for NMR imaging systems.

Lastly, but not limited hereto, it is an object of the present invention to provide a cryostat having a liquid coolant access fill port having a horizontal orientation, that is, an orientation which is disposed substantially parallel to the longitudinal axis of the inner cryostat.

DESCRIPTION OF THE FIGURES

The subject matter which is regarded as the invention is particularly pointed out and distinctly claimed in the concluding portions of the specification. The invention, however, both as to organization and method of practice, together with further objects and advantages thereof may best be understood by reference to the following description taken in connection with the accompanying drawings in which:

DETAILED DESCRIPTION OF THE INVENTION

Figure 1:
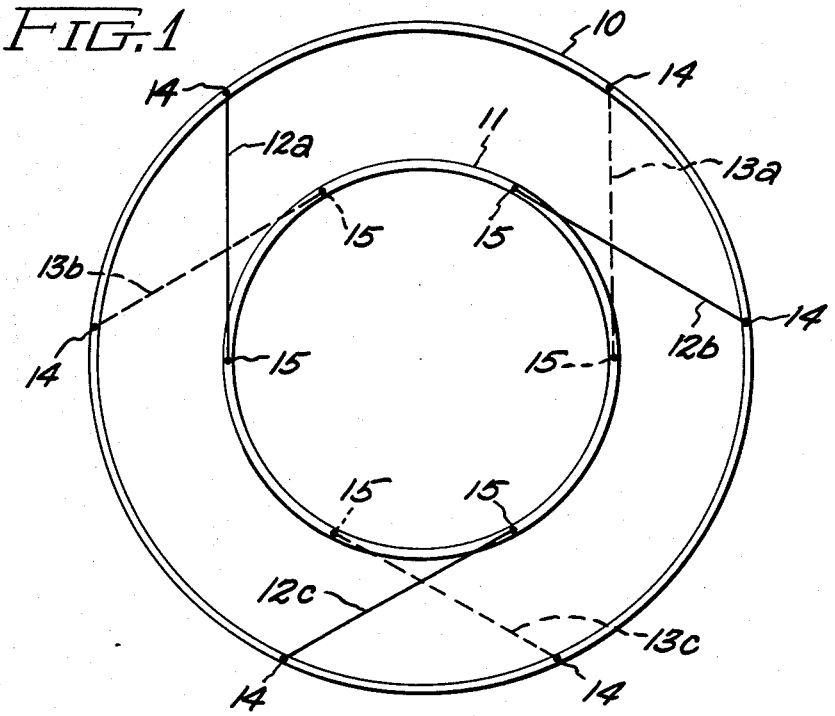
FIG. 1 is an end view schematic diagram illustrating the essential principles involved in the suspension system of the present invention.
Figure 2:
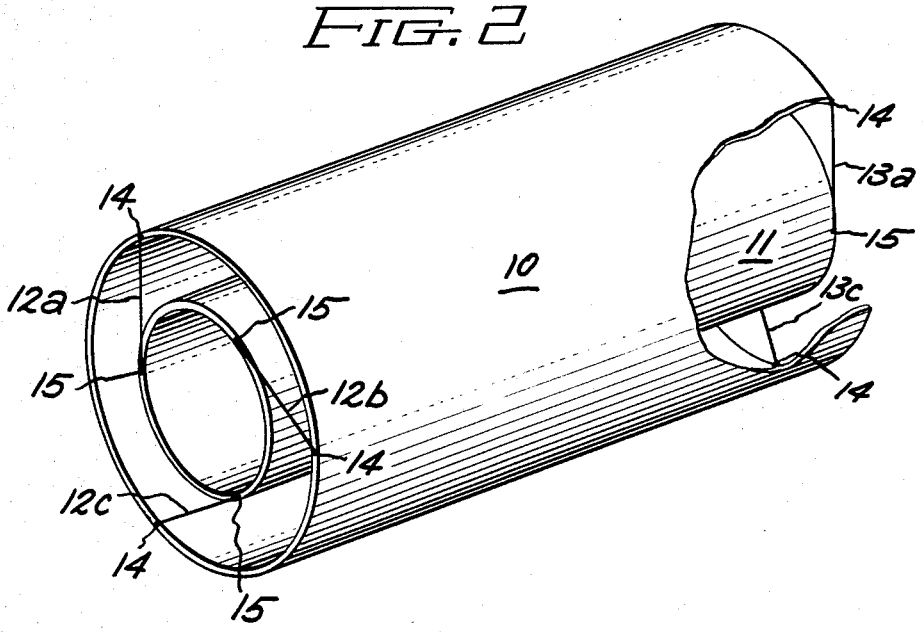
FIG. 2 is a partially cut-away, isometric view of the suspension system with the end view illustrated in FIG. 1.

FIGS. 1 and 2 depict in a basic fashion the essential elements of the interior cryostat suspension system which forms an important aspect of the present invention. FIGS. 1 and 2 schematically illustrate a method for suspending one cylinder within another. In a cryostat, one wishes to suspend the interior vessel in such a way that there is minimal physical contact between the inner and outer vessels. This permits the volume between the vessels to be evacuated to provide thermal insulation. The only permanent mechanical connection between the inner and outer vessels or cylinders in the present invention is a system of high strength, low thermal conductivity ties. Such a system is illustrated in FIGS. 1 and 2. In particular, FIG. 1 illustrates outer cylinder 10 in which inner cylinder 11 is suspended by means of a system of six supporting ties (three at each end). At one end of the cylinders, ties 12*a*, 12*b* and 12*c* extend in a transverse direction between attachment points 15 on inner cylinder 11 and attachment points 14 on outer cylinder 10. A corresponding set of supporting ties 13*a*, 13*b* and 13*c* is disposed at the other end of cylinders 10 and 11 and serve a similar function. However, the supporting sets of ties at opposite ends of the cylinders are preferably configured in a mirror image symmetry pattern with respect to one another. However, strict mirror symmetry is not required as long as one set of ties is disposed in a rotationally opposing direction with respect to the other set. Furthermore, attachment points may be located substantially uniformly about the periphery of cylinders 10 and 11. This configuration produces a relatively uniform distribution of stress in the supporting ties. In a preferred embodiment of the present invention, there are three supporting ties in each tie set. This preference is the result of two conflicting objectives. First, in order to provide maximal conductive thermal insulation between the inner and outer cylinders, it is desired to have as few supporting ties as possible. Since it is highly desirable that the supporting ties exhibit minimal thermal conductance, it is therefore also generally desirable that the cross-sectional area of the ties be relatively small and that the ties themselves comprise a material exhibiting low thermal conductivity. Even though the desire for thermal insulation in a supporting tie system would seemingly suggest the utilization of supporting ties which would tend to lack tensile strength, such strength is often more readily provided by materials having undesirably high thermal conductivities and large cross-sectional areas. Accordingly, it is seen that the second competing requirement is that there be sufficient strength in the supporting ties to carry the weight of the inner cylinder. Furthermore, during transport of the assembly shown in FIGS. 1 and 2, forces other than the weight of the cylinders can be produced which provide additional loads on the supporting tie system. Accordingly, the requirement of strength tends to indicate that a relatively large number of supporting ties is desirable. Since a system in which there are only two supporting ties, one at each end of the cylinders, is insufficient to prevent certain transverse relative motions between the inner and outer cylinders, it is necessary to employ a system of ties in which there are at least three supporting ties at each end of the cylinder to be supported. While additional supporting ties would seem to be desirable to provide additional strength, judicious selection of the supporting tie material obviates the necessity for additional supporting ties. However, more ties could be provided if otherwise desired. In the selection of the materials for supporting ties 12*a*, 12*b*, 12*c*, 13*a*, 13*b*, and 13*c*, high strength, low thermal conductivity materials such as glass fiber, carbon or graphite composite or titanium are preferably employed. Such materials provide the requisite strength while at the same time exhibiting a low degree of thermal conductivity. The material itself may be configured either in the form of a rod, loop or, as appropriate, a braided strand.

The view shown in FIG. 1, in end elevation form, is shown again in FIG. 2 in an isometric view so as to more clearly point out the structures provided at the ends of the cylinders. FIG. 1 on the other hand more clearly illustrates the uniform disposition of the attachment points and the opposed locational and mirror image relationship between the tie sets at opposite ends of the cylinders.

While FIGS. 1 and 2 illustrate certain fundamental aspects of the suspension system of the present invention, the remaining figures are provided to illustrate the utilization of this suspension system and its cooperation with other aspects of the present invention in a cryostat which is particularly useful for whole body NMR imaging. In particular, the cryostat illustrated in the remaining figures is particularly suited for maintaining a superconductive material at a temperature below the critical temperature so that persistent currents set up in electrical windings surrounding the bore of the cryostat act to produce a high strength, relatively uniform magnetic field within the bore of the annular cryostat.

Figure 3:
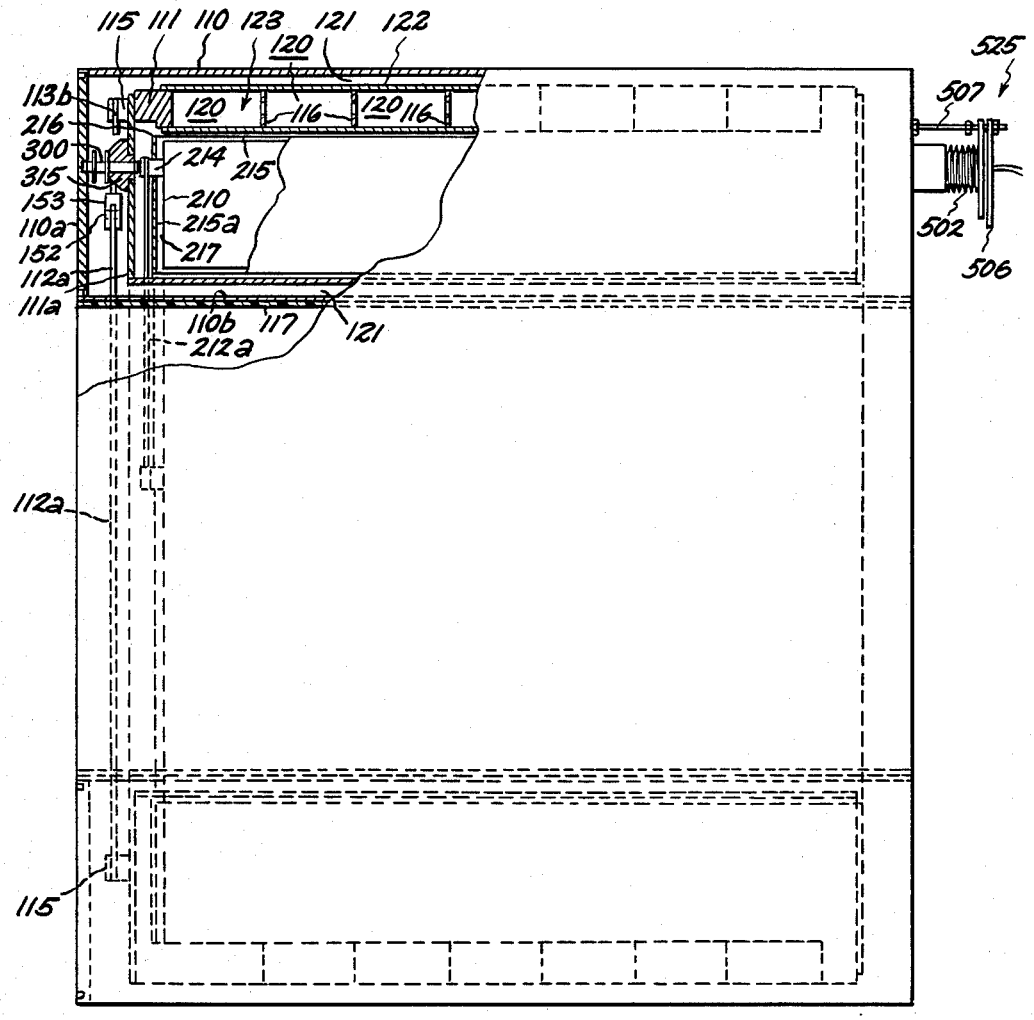
FIG. 3 is a partially cut-away, cross-sectional, side-elevation view of a cryostat of the present invention which is particularly useful for containing superconductive windings for the purpose of generating high strength magnetic fields for NMR imaging applications.

FIG. 3 is a partially cut away, partially cross-sectional, side-elevation view of a cryostat in accordance with a preferred embodiment of the present invention. In particular, the cryostat of the present invention includes outer, evacuable vessel 110. Outer vessel 110 preferably possesses an annular shape and preferably possesses an inner bore diameter of approximately one meter for the purposes of whole body imaging. It is outer vessel 110 which provides support for those structures contained therein. Outer vessel 110 also includes end plates 110*a* disposed at each end thereof. Outer vessel 110 also possesses a thin inner shell 110*b* that is preferably made of high electrical resistivity alloy, such Inconel X625. The thickness of inner shell 110*b* is typically between about 0.02 and 0.03 inches, and its high material resistivity (about $130\times10^{-6}$ ohm-cm) is selected so as to provide a short eddy current time constant (approximately 0.12 milliseconds) compared to the gradient field rise time (about 1 millisecond). The gradient fields are generated by coils (not shown) disposed within the annular bore of the cryostat. These coils do not form a material aspect of the present invention.

It is furthermore pointed out that the Inconel X625 inner shell makes excellent welded joints and accordingly, an all welded outer or exterior vessel is provided in the preferred embodiment of the present invention. Furthermore, to prevent buckling of inner shell 110*b*, fiberglass cylinder 117 may be inserted within the cryostat bore. In general, when the cryostat of the present invention is employed in conjunction with high strength magnetic fields, the various vessels shown in FIG. 3 typically comprise aluminum, except as otherwise noted herein, and except for outer vessel 110 which may comprise stainless steel, particularly for the reasons discussed above.

Figure 4:
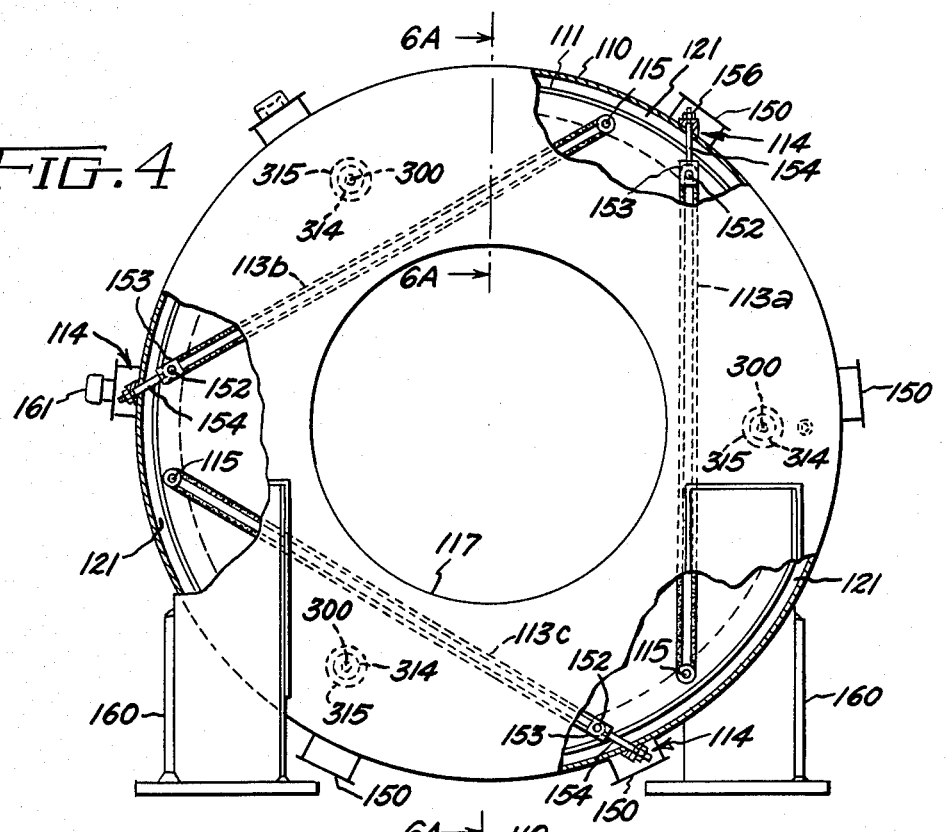
FIG. 4 is a partially cut-away, partially cross-sectional end view of the cryostat of FIG. 3, particularly illustrating the suspension of the interior vessel within an outermost vessel.
Figure 5:
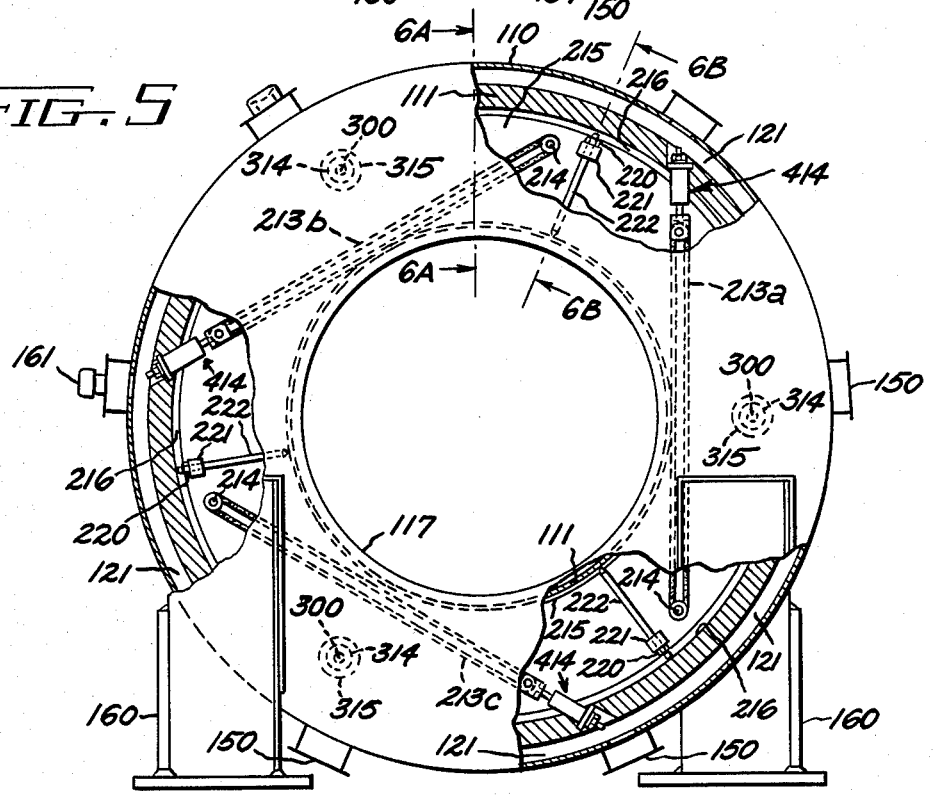
FIG. 5 is also a partially cut-away, partially cross-sectional end view of the cryostat of FIG. 3 which, however, more particularly illustrates the suspension of the innermost vessel from the intermediate or interior vessel.

Because of some of the mechanical complexities of the apparatus of the present invention, the fullest appreciation thereof may best be had by a relatively simultaneously viewing of FIGS. 3, 4, 5, 6A and 6B. FIGS. 4 and 5 provide end views more particularly illustrate the suspension system. The side elevation, cross-sectional detail views of FIGS. 6A and 6B more particularly illustrate the nesting of the various annular vessels employed.

FIG. 3 also illustrates interior vessel 111, having an annular configuration. In particular, it is seen that interior vessel 111 is suspended within outer vessel 110 by means of a system of supporting ties. In particular, supporting tie 112*a* is seen to be attached to a fixed point on vessel 110 by means of yoke 153. The other end of supporting tie 112*a* is connected to a boss 115 (seen in the lower portion of FIG. 3) on vessel 111. Boss 115 is typically welded to interior vessel 111. The supporting ties of the present invention preferably comprise titanium rods, graphite or carbon fiber composites or glass fiber material. In particular, the supporting ties of the present invention are shown as loops of appropriately selected material. The loops are held in place in boss 115 by means of circular channels therein. Additionally, it is also seen for example, that supporting tie 112*a* is held in position within yoke 153 by means of pin 152, which may be force fit into corresponding circular apertures in the side of yoke 153. FIG. 3 also illustrates that vessel 111 is supported by means of supporting tie 113*b* which is shown in part disposed about upper boss 115. Supporting tie 113*b* is attached at its other end (not visible) to outer vessel 110. Accordingly, it is seen that outer vessel 110 and interior vessel 111 thereby define volume 121 which is evacuated to provide the desired degree of thermal isolation between ambient and internal temperature conditions.

Interior vessel 111 preferably comprises a material such as aluminum and preferably exhibits an all-welded construction. Interior vessel 111 also preferably possesses outer jacket 123 which defines an annular volume 120 for containing a coolant such as liquid nitrogen. Additionally, multi-layer insulation 122 may also be disposed around vessel 111 for the purpose of reducing radiation heat transfer. Accordingly, vessel 111 acts as a thermal radiation shield which is maintained at a temperature of approximately 77° K. Jacketed shield 111 is actively cooled by the boiling of liquid nitrogen that is disposed within shield outer jacket 123. Outer jacket 123 also preferably includes perforated baffles 116, for additional strength and rigidity against buckling which may develop as a result of the vacuum.

Figure 6B:
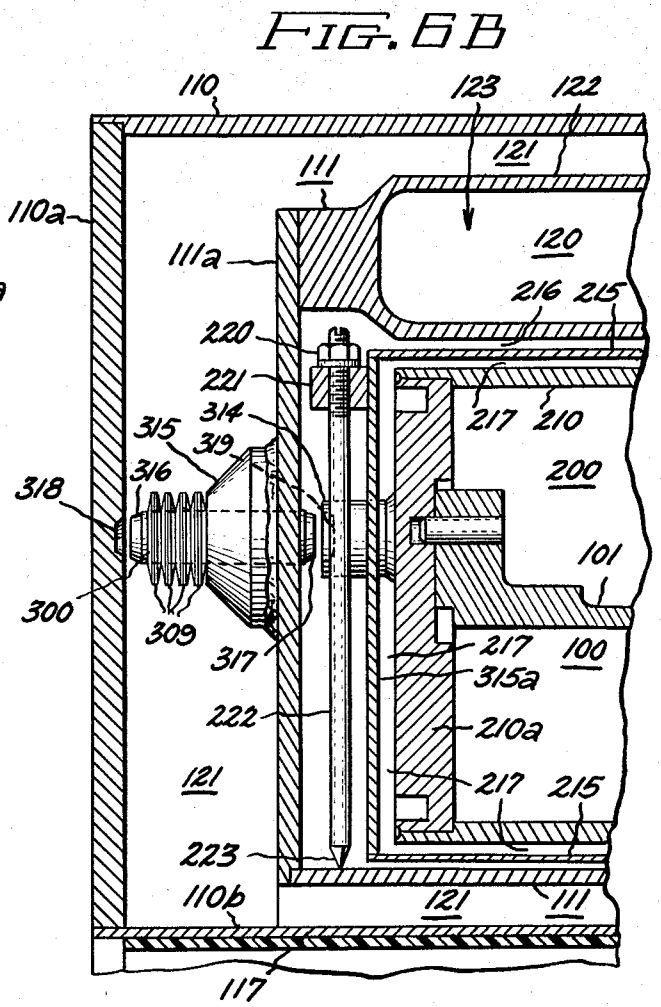
FIG. 6B is a cross-sectional, side-elevation view of a portion of the cryostat of FIG. 3 which illustrates in detail one of the pins which is employed to assist in positioning the interior vessels in a fixed axial position and which also illustrates the suspension system for a shield between the innermost vessel and the interior vessel.

An additional thermal radiation shield 215 may be provided within the annular volume of vessel 111. Thermal radiation shield 215 is not illustrated in detail in FIG. 3. However, FIG. 6B illustrates, in detail, the mechanism for positioning this shield.

Finally, FIG. 3 illustrates innermost vessel 210 suspended wholly inside of radiation shield 215. The construction of innermost vessel 210 may be more readily discerned from FIGS. 6A and 6B. However, FIG. 3 is sufficient to illustrate, at least partially, the mechanism for suspending innermost vessel 210 within shield 215 and within interior vessel 111. In particular, boss 214, which is preferably welded to innermost vessel 210 is seen to extend through shield 215 (see FIGS. 5 and 6A). Boss 214 is seen to provide an attachment point for supporting tie loop 212*a*. The other end (not shown) of supporting tie 212*a* is attached to vessel 111 in a view more particularly shown in FIG. 5.

Also partially visible in FIG. 3 is a transport or shipping mechanism 525 which functions to hold vessels 110, 111 and 210 in a fixed axial position during cryostat transport. This system is more particularly illustrated in FIGS. 8 and 8A. It is noted here, however, that the apparent alignment of pin 300 with boss 214 in FIG. 3 is merely an effect of perspective. A better appreciation of the position of pin 300 and boss 214 may be had from the view presented in FIG. 5.

A significant feature of the cryostat of the present invention is that it is provided with a horizontally disposed set of access ports and tubes for the supply of liquid nitrogen to jacket 123 and also for the supply of liquid helium to innermost vessel 210. Liquid helium access port 525 shown on the right hand portion of the cryostat of FIG. 3 is more particularly shown in detail in FIGS. 8 and 8A, and is discussed in detail below.

FIG. 4 is a partially cut away end view of a cryostat in accordance with a preferred embodiment of the present invention in which the system for suspending interior vessel 111 within outer vessel 110 is particularly illustrated. In particular, it is seen that supporting ties 113*a*, 113*b* and 113*c* extend from bosses 115 and on vessel 111 to corresponding attachment points 114 on exterior vessel 110. Exterior vessel 110 may, if desired, be supported on pedestals 160. A detailed description of attachment point 114 structure may be found in the discussion below with respect to FIG. 7A. In FIG. 4, boss 115 is seen attached to interior vessel 111. The suspension system shown maintains outer vessel 110 and interior vessel 111 in a spaced apart position so as to define volume 121 therebetween. However, it is noted that, in general, the interior region of vessel 110 is maintained in an evacuated condition. This condition is maintained by cover plates 150 which cover access ports which are used for tensioning the supporting ties, particularly during assembly. Vacuum conditions may for example be produced through vacuum seal-off 161. Additionally, transport or shipment pins 300 are shown in phantom view in FIG. 4. In fact, FIG. 4 is the figure which best illustrates the positioning of these pins. Also shown in phantom view is boss 315 which is affixed to interior vessel 111. Also shown in FIG. 4, in phantom view, is boss 314 which is attached to innermost vessel 210 and which extends through radiation shield 215. An additional view of the support structure is seen in FIG. 6B, which is a cross-sectional representation along the corresponding line shown in FIG. 5. Furthermore, cross-sectional line 6A is also shown in FIG. 4 and corresponds to FIG. 6A which is more particularly discussed below.

While FIG. 4 illustrates the suspension of vessel 111 within exterior vessel 110. FIG. 5 is provided to more particularly illustrate the suspension of innermost vessel 210 within interior vessel 111. As above, interior vessel 111 is preferably a jacketed vessel possessing outer jacket 123. However, jacket 123 is not visible in the sectional view of FIG. 5. Additionally, innermost vessel 210 is also not visible because of the presence of surrounding thermal radiation shield 215. While it could appear that boss 214 is attached to shield 215, in actuality, boss 214 is affixed to end plate 210*a* of innermost vessel 210 (see FIG. 6A). Supporting ties 213*a*, 213*b* and 213*c* are employed to suspend innermost vessel 210 from interior vessel 111. Supporting ties 213*a*, 213*b*, and 213*c* extend from bosses 214 to attachment points 414 on interior vessel 111. The detailed construction of these attachment points is more particularly illustrated in FIG. 7B discussed below. Accordingly, it is seen that there is defined volume 216 disposed between radiation shield 215 and interior vessel 111. As above, this is preferably an evacuated volume, the evacuation being performed through seal 161. Additionally shown in FIG. 5 is a method for suspending thermal radiation shield 215 from the interior wall portion of interior vessel 111. This suspension system is more particularly shown in FIG. 6B, discussed below. FIG. 6B is a cross-sectional view through the line illustrated in FIG. 5. It is also noted that adjustment for tension in supporting ties 213*a*, 213*b* and 213*c* is effected through removal of cover plates 150.

Figure 6A:
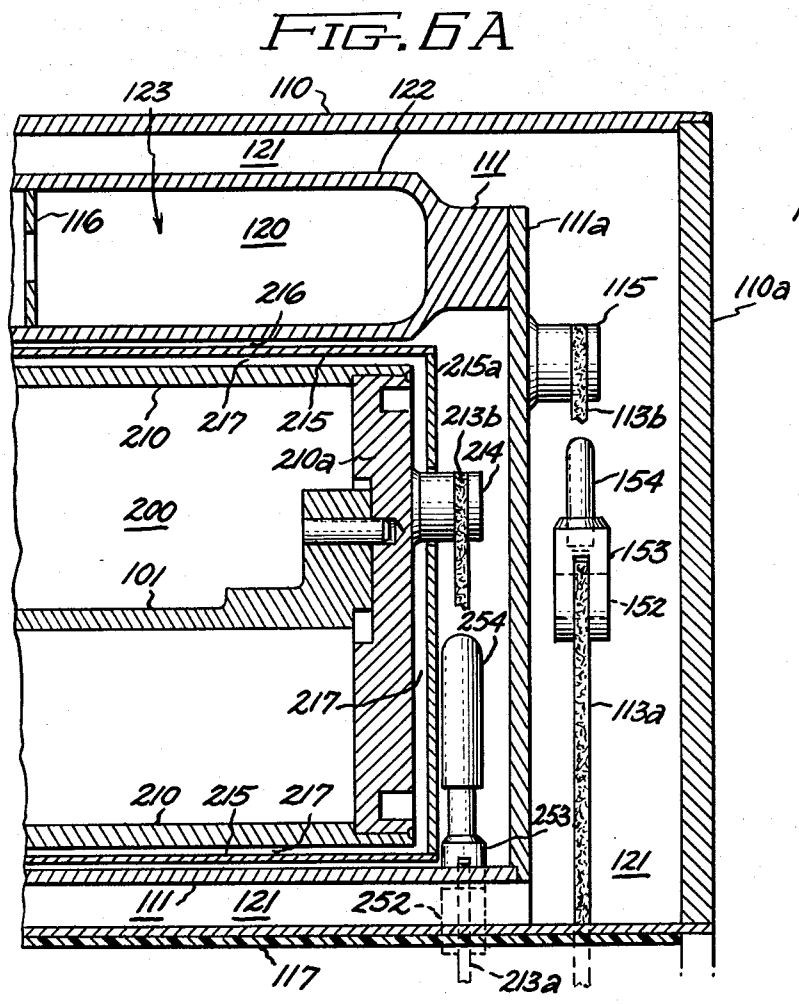
FIG. 6A is a cross-sectional, side-elevation view of a portion of the cryostat of FIG. 3, which more particularly illustrates the suspension system for the interior vessel and the innermost vessel.

FIG. 6A is a cross-sectional side elevation view through the line shown in FIGS. 4 and 5. However, for clarity, the suspension system for thermal shield 215 is omitted from this view. However, it is shown in FIG. 6B discussed below. The suspension system for innermost vessel 210, interior vessel 111 and exterior vessel 110 is nonetheless particularly illustrated in the view of FIG. 6A. In particular, supporting tie 113*a* is seen disposed about pin 152 in yoke 153 which is attached to partially threaded shaft 154 which extends through the wall of exterior vessel 110. The portion of shaft 154 extending beyond the wall of exterior vessel 110 is particularly illustrated in FIG. 7A. Additionally, supporting tie 213*a* (in phantom) is seen disposed about pin 252 (also in phantom) which extends through yoke 253 which in turn is attached to shaft 254 which extends through the wall of interior vessel 111. The portion of shaft 254 which extends through this wall is seen in FIG. 7B. Also shown in FIG. 6A is boss 115 which is attached to end plate 111*a* of interior vessel 111 and is employed as an attachment point for supporting tie 113*b*. In a like manner, boss 214 is shown attached to end plate 210*a* of innermost vessel 210 and extends through end plate 215*a* of thermal radiation shield 215. Boss 214 serves as an attachment point for supporting tie 213*b*, only a portion of which is shown, for purposes of clarity.

In those applications in which the present invention is particularly desired for the generation of high intensity magnetic fields produced by superconductive windings, innermost vessel 210 is further divided into annular volumes 100 and 200 as shown by means of cylindrical shell 101 which is disposed therein. In such cases volume 100 contains electrical windings comprising superconductive material. Volume 200 is typically filled with a low temperature coolant such as liquid helium. The means for introducing liquid coolant into volume 200 is more particularly illustrated in FIG. 8, discussed below.

Figures 8, 8A, 9:
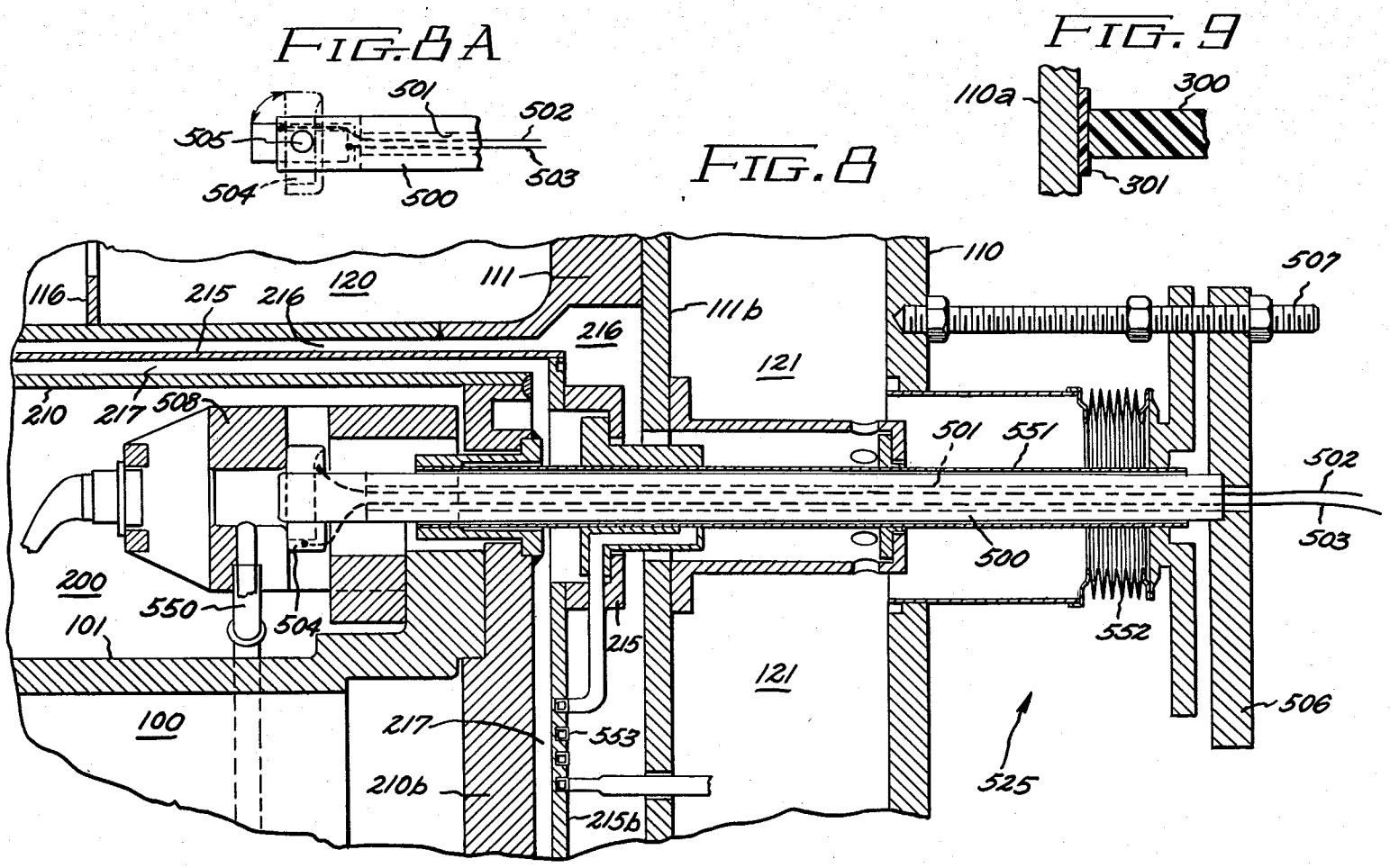
FIG. 8 is a partially cross-sectional, side-elevation view taken through the horizontally oriented liquid coolant access fill tube of the present invention particularly illustrating the disposition of the positioning rod which is used to move the interior and innermost vessels into contact with the transport pins during transport.
FIG. 8A is a detailed side-elevation view of the end of the positioning rod shown in FIG. 8.
FIG. 9 is a cross-sectional side-elevation view illustrating an alternative pin configuration.

FIG. 6B is a cross-sectional side-elevation view taken along the cross-sectional line shown in FIG. 5. However, for purposes of clarity, boss 214 and supporting tie 213*b* are not shown in FIG. 6B. FIG. 6B is particularly relevant for illustrating two facets of the present invention. Most importantly, the transport or shipping pin system is shown in detail. Secondly, means for positioning thermal radiation shield 215 is shown. As noted above, the suspension system of the present invention permits axial motion of interior vessel 210 in an axial direction. Typically, movement of approximately $\frac{3}{4}$ of an inch is permitted. This movement is accomplished by means of transport rod 500 inserted into liquid helium access tube 551, as shown in FIG. 8. The resultant axial motion moves transport pin 300 having beveled edges 316 and 317 into contact with mating recess 318 in end plate 110*a* of exterior vessel 110. Transport pin 300 is also disposed through and affixed through boss 315 and extends through end plate 111*a* of interior vessel 111. The axial motion also causes contact between beveled end 317 of pin 300 and a correspondingly shaped aperture 319 in boss 314 which is affixed to end plate 210*a* of innermost vessel 210. As noted above, boss 314 extends through an aperture (not visible) in end wall 215*a* of radiation shield 215. Additionally, pin 300 may be provided with Belleville washers 309 to absorb impacts due to shock loading during transport and to assist in returning the assembly to its normal axial alignment position after transport. Pins 300 typically comprise a material such as titanium which exhibits high compressive strength but low thermal conductivity. Furthermore, it is also possible to employ pins comprising glass fiber material and more particularly to employ glass fiber pins in which the ends are not beveled. This latter embodiment of the present invention also does not employ apertures such as 318 or 319 into which pin 300 is disposed during transport. This configuration is particularly desirable in those situations in which it is desirable to avoid the necessity of precise positioning of the pin assemblies so that alignment between the pins and the beveled apertures into which they are inserted is not a problem. In the embodiment shown however, proper dimensioning of the transport system is preferred to assure proper pin alignment.

FIG. 6B is also relevant in that it shows a system for suspending thermal radiation shield 215 from interior vessel 111. In particular, it is seen that a plurality of circumferentially disposed bosses 221 are attached to thermal radiation shield 215. Through these threaded bosses there is disposed a partially threaded rod 222 having pointed tip 223. Tip 223 rests on the inner surface of interior vessel 111 and helps provide minimal thermal conduction through rod 222. Rotation of threaded rod 222 is employed to position radiation shield 215, the position being locked in place by means of nut 220. Rod 222 comprises a low thermal conductivity material such as glass fiber, titanium or a boron or graphite composite. The placement of rod 222 is also particularly seen in FIG. 5. Additionally, it is seen that radiation shield 215 and innermost vessel 210 define volume 217 disposed therebetween.

Figure 7A:
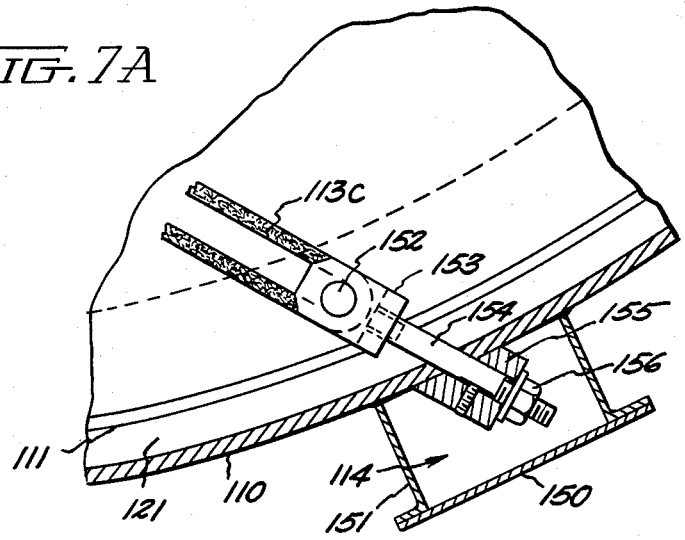
FIG. 7A is a partial cross-sectional, side-elevation view illustrating the supporting tie attachment configuration for those ties connecting the exterior vessel and the intermediate (interior) vessel.
Figure 7B:
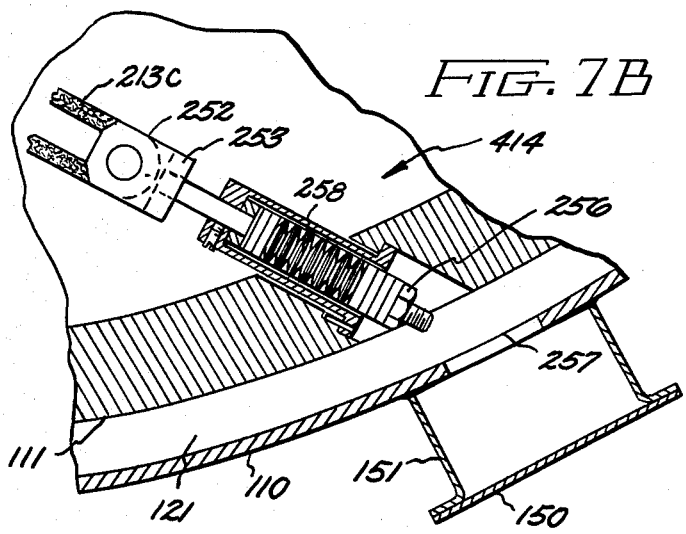
FIG. 7B is a view similar to FIG. 7A showing the supporting tie attachment configuration for those ties connecting the intermediate (interior) vessel with the innermost vessel.

Outer attachment points 114 for the suspension of interior vessel 111 are shown in detail in FIG. 7A. In particular, supporting tie 113*c* is seen disposed about pin 152 in yoke 153 which is attached, as by thread means for example, to shaft 154 which extends through the outer wall of exterior vessel 110. Shaft 154 is also disposed through exterior boss 155 in which it is held by nut 156 by which means the tension in supporting tie 113*c* may be adjusted. Shaft 154 extends into a volume defined by the outer wall of vessel 110, oval tension access port housing 151 and access port cover 150. This exterior housing structure is constructed to be airtight so as to preserve interior vacuum conditions.

Figure 7C:
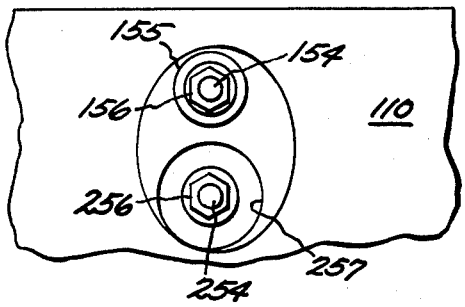
FIG. 7C is a side view of a side access port through which tension in the supporting ties may be adjusted.

In a similar fashion, supporting tie 213*c* is disposed about pin 252 in yoke 253 possessing a threaded shaft 254 which extends through interior vessel 111. Tension in shaft 254 is fixed by means of adjustable nut 256. Additionally, Belleville washers 258 are preferably provided. Access to nut 256 is available through aperture 257 in the wall of exterior vessel 110. Access to aperture 257 is provided through access port housing 151. The configuration of tensioning nuts 156 and 256 may also be appreciated from the bottom, nonsectional view in FIG. 7C in which the same objects are seen to possess corresponding reference numerals. More particularly, the oval shape of housing 151 is likewise best appreciated in this view.

As indicated above, an important aspect of the present invention is the ability to axially displace innermost vessel 210 and interior vessel 111 in an axial direction so as to permit pins 300 to abut against end plate 110*a* and boss 314. The drawings in FIG. 8 and FIG. 8A more particularly illustrate the manner in which this is accomplished. In particular, there is shown a horizontal liquid helium fill access port having external portion 525 which is also visible in FIG. 3. Liquid helium may be supplied to volume 200 through conduit 551 extending from the exterior through to the interior of innermost vessel 210. To insure that liquid helium filling occurs from the bottom of volume 200 to a point at which at least the top of shell 101 is covered, tube 550 is provided so as to extend into the lower portion of volume 200. In order to move innermost vessel 210 so that the boss 314 contacts pin 300 and so that ultimately pin 300 is placed in contact with end plate 110*a* of exterior vessel 110, transport or shipping shaft 500 is inserted through conduit 551. To understand the construction and utilization of shipping shaft 500, it is useful to refer to the detailed illustration of the end portion of shipping shaft 500 found in FIG. 8A. In particular, it is seen that shipping shaft 500 terminates in a pivotable tee portion 504 which rotates about pin 505 when strings 502 or 503 are pulled. Thus, shipping shaft 500 is initially inserted through conduit 551 with pivotable tee portion in a position in which it is aligned with the longitudinal axis of shaft 500. Thereupon tension may be applied to string 502 to pivot the tee portion about pin 505 so as to configure shaft 500 in the general form of an elongated letter "T". Pressure may then be applied by plate 506 so that the now T-shaped shaft 500 abuts against block 508 which is firmly affixed to the interior of innermost vessel 210. Continued application of pressure by means of plate 506, such as by rotation of nuts on threaded shaft 507 moves the interior portion of the cryostat into an abutting configuration, as described above. It is in this configuration in which the cryostat of the present invention may be shipped, with or without liquid coolants in place and with volumes 121, 216 and 217 being evacuated. Upon arrival at the desired destination pressure plate 506 may be removed and tension applied to string or cable 503 to rotate tee portion 504 back into alignment with the longitudinal axis of shipping shaft 500 for removal. Accordingly, shipping shaft 500 is provided with central channel 501 through which strings, cords or cables 502 and 503 are disposed.

Also illustrated in FIG. 8 is the fact that block 508 is firmly affixed to either or both shell 101 and end plate 210*b* of innermost vessel 210. It is also seen that end plate 215*b* of thermal radiation shield 215 is preferably provided with conduits 553 through which boiled off liquid helium is made to pass in order to provide cooling for the radiation shield. Lastly, it is seen that the exterior portion of the horizontal helium access port is provided with bellows assembly 552 which is seen to supply a useful expansion and contraction compensation mechanism which may be needed because of the large temperature differences between the interior and exterior of the cryostat. It is also seen, that thermal radiation shield 215 may also be partially supported by means of conduit 551. Radiation shield 215 is typically cooled to a temperature between about 20° K. and about 65° K. by boil-off of helium vapor that circulates in heat exchange coil 553 which is in thermal contact with end plate 215*b*.

Multi-layer insulation 122 may also be provided around the exterior of liquid nitrogen cooled interior vessel 111 to reduce radiation heat transfer. Only one layer of such insulation, however, may be inserted in volume 216 between liquid nitrogen cooled vessel 111 and helium cooled shield 215. Additionally, only one layer of such insulation may be disposed in volume 217 between helium cooled shield 215 and the innermost vessel 210 to reduce the emissivity of these surfaces.

Another aspect of the present invention is the provision for an exterior vessel 110 which comprises an all-welded design. This is facilitated by the employment of an inner wall 110*b* for vessel 110 comprising Inconel X625, which makes excellent welded joints to dissimilar metals such as 300 series stainless steels. As discussed above, prevention of buckling in wall 110*b* is facilitated by the insertion of glass fiber cylinder 117.

FIG. 9 illustrates an alternative pin configuration for the present invention. In particular, in those circumstances in which it is desired to ship the cryostat of the present invention in a cooled-down condition, it is preferable to place the cryostat in a vertical position so that the end of the cryostat with pin 300 is at the bottom. For vertical shipment of the cryostat, the alternative pin configuration, shown in FIG. 9, is preferred. In particular, in such a case it is desired to employ pins, such as pin 300 in FIG. 9, having flat, rather than beveled faces. Furthermore, in this embodiment, recess 318 is no longer necessary. Instead, flat disc 301, comprising a material such as glass fiber and epoxy, is employed as an abutting surface against which pin 300 is in contact during shipment. In this case, pin 300 also preferably comprises a material such as glass fiber and epoxy. The pin configuration illustrated in FIG. 9 is also seen to eliminate the need for precise pin alignment.

From the above, it may be appreciated that the present invention provides a cryostat which fully and capably meets the objects expressed above. In particular, it is seen that the cryostat of the present invention is particularly suitable for transport, particularly in a vertical position, in which full vacuum and coolant conditions are maintained. It is also seen that the cryostat of the present invention is also particularly useful in those applications in which it is desired to construct electromagnets employing superconducting windings. Such windings (not shown herein) are disposed about the central core of the cryostat so as to be particularly useful in generating high intensity, relatively uniform magnetic fields along the longitudinal axis of the cryostat bore. In this fashion, the present invention provides a useful device for NMR imaging systems. It is also seen that the present invention avoids costly and time consuming disassembly of the cryostat and specifically avoids cryostat designs in which frequent or continual pumping is required for maintenance of vacuum conditions. It is also seen that the cryostat of the present invention eliminates both the elastomer seals and nonmetallic bore tubes which are permeable to gases and can result in long-term contamination of interior vacuum conditions. Accordingly, costly periodic pumping of cryostat vacuum is not required. Moreover, the present invention avoids conditions which tend to result in shutting down and warming up of the magnet.

While the invention has been described in detail herein in accord with certain preferred embodiments thereof, many modifications and changes therein may be effected by those skilled in the art. In particular it is not necessary for the supporting tie sets shown herein to be in substantially the same plane. Accordingly, it is intended by the appended claims to cover all such modifications and changes as fall within the true spirit and scope of the invention.

What is claimed is:

1. A cryostat comprising:

a substantially rigid outer, evacuable vessel having an annular shape;

a substantially rigid interior vessel having an annular shape and being wholly contained within said outer vessel so that the central axis of said interior vessel and said outer vessel lie substantially along the same line;

a first set of at least three supporting ties extending transversely from attachment positions on a first end of said interior vessel to said corresponding attachment points on the proximal end of said outer vessel, said attachment points on said first end of said interior vessel being substantially uniformly disposed about the periphery thereof and said corresponding attachment points on said outer vessel being substantially uniformly disposed about said outer vessel; and a second set of at least three supporting ties extending transversely from attachment points on a second end of said interior vessel to corresponding attachment points on the proximal end of said outer vessel, said attachment points on said second end of said interior vessel being substantially uniformly disposed about the periphery thereof and said corresponding attachment points on said outer vessel being substantially uniformly disposed about said outer vessel;

said first set of ties being disposed so as to inhibit relative rotation of said outer and said interior vessels in a first rotational direction and said second set of ties being disposed so as to inhibit relative rotation of said vessels in the opposite rotational direction.

2. The cryostat of claim 1 in which said supporting ties comprise glass fiber.

3. The cryostat of claim 2 in which said interior vessel includes an outer jacket for the containment of liquid coolant.

4. The cryostat of claim 1 in which said supporting ties comprise titanium.

5. The cryostat of claim 1 further including means for adjusting tension in said supporting ties.

6. The cryostat of claim 1 further comprising:

a substantially rigid innermost vessel having an annular shape and being wholly contained within said interior vessel so that the central axis of said innermost vessel and said interior vessel lie substantially along the same line;

a third set of at least three supporting ties extending transversely from attachment positions on a first end of said innermost vessel to corresponding attachment points on the proximal end of said interior vessel, said attachment points on said first end of said innermost vessel being substantially uniformly disposed about the periphery thereof and said corresponding attachment points on said interior vessel being substantially uniformly disposed about said interior vessel; and a fourth set of at least three supporting ties extending transversely from attachment points on the second end of said innermost vessel to corresponding attachment points on the proximal end of said interior vessel, said attachment points on said second end of said innermost vessel being substantially uniformly disposed about the periphery thereof and said corresponding attachment points on said interior vessel being substantially uniformly disposed about said interior vessel;

said third set of ties being disposed so as to inhibit relative rotation of said interior and innermost vessels in a first rotational direction and said fourth set of supporting ties being disposed so as to inhibit relative rotation of said interior and innermost vessels in the opposite rotational direction.

7. The cryostat of claim 6 further including a plurality of pins disposed at one end of said interior vessel so as to provide contact between said vessels especially during shipment.

8. The cryostat of claim 7 further including means to move said innermost vessel and said interior vessel in an axial direction.

9. The cryostat of claim 8 in which said axial moving means includes a rod inserted into an access port for adding liquid coolant to said innermost vessel.

10. The cryostat of claim 6 further comprising: a liquid coolant supply port for supplying said coolant to said innermost vessel, said access port being oriented substantially parallel to said axes.

11. The cryostat of claim 6 further including a thermal radiation shield disposed between said innermost vessel and said interior vessel.

12. The cryostat of claim 6 further including a cylindrical partition disposed within said innermost vessel so as to partition said innermost vessel into a radially inner volume and a radially outer volume.

13. The cryostat of claim 12 further including electrical windings comprising superconductive material disposed within the radially inner volume of said innermost vessel.

14. The cryostat of claim 6 further including means for adjusting tension in said supporting ties.

15. The apparatus of claim 1 further including a cylindrical glass fiber support tube in an abutting relationship with radially inner wall of said outer vessel.

16. The cryostat of claim 1 in which said first and second set of said supporting ties are disposed substantially in mirror image symmetry to each other with respect to a plane including said axes, as viewed from the axial direction.

* * * * *